US005944550A

United States Patent [19]

Vindigni

[11] Patent Number: 5,944,550

[45] Date of Patent: Aug. 31, 1999

[54] ELECTRICAL CONNECTION DEVICE LOCKABLE IN THE OPEN POSITION

[75] Inventor: Henri Vindigni, Alfortville, France

[73] Assignee: Societe d'Exploitation des Procédes Marechal (SEPM), Saint-Maurice Cedex, France

[21] Appl. No.: 08/982,357

[22] Filed: Dec. 2, 1997

[30] Foreign Application Priority Data

Dec. 2, 1996 [FR] France ..... 96 14760

[51] Int. Cl.[6] ..... H01R 4/50

[52] U.S. Cl. ..... 439/333; 439/133

[58] Field of Search ..... 439/133, 304, 439/312, 333

[56] References Cited

U.S. PATENT DOCUMENTS

| | | |
|---|---|---|
| 3,585,323 | 6/1971 | Appleton et al. . |
| 3,755,772 | 8/1973 | Reed . |
| 4,516,819 | 5/1985 | Le Magourou . |
| 4,550,966 | 11/1985 | Riley . |
| 5,108,297 | 4/1992 | Hoffman et al. . |

FOREIGN PATENT DOCUMENTS

| | | |
|---|---|---|
| 2531577 | 8/1982 | France . |
| 2258769 | 2/1993 | United Kingdom . |

OTHER PUBLICATIONS

Copy of a French Search Report and Annex issued with French App. No. 96. 14760.

*Primary Examiner*—Khiem Nguyen

*Attorney, Agent, or Firm*—Greenblum & Bernstein, P.L.C.

[57] ABSTRACT

Electrical connection device lockable in an open position provided with a plug having a cylindrical body equipped with internal contact pins and a power transmitting female element in the form of a socket or a coupler socket of an extension cord, and having a casing equipped with internal contacts and an external rotational ring that projects by extending beyond the casing and intended to lock and unlock the plug from or into the connection position. Coupling is accomplished via paired guide elements provided on the plug and female element by at least one first translational movement of the plug in the female connection followed by a rotation and a second translation until the closed connection position is obtained. The device is especially characterized in that the body of the plug is provided at its base with a locking tab that extends axially in the direction of the coupling and at a distance from the body so as to be able to pass above the locking ring during coupling, and in that the tab and the locking ring each have an opening, the angular positions of the openings and the longitudinal position of the opening of the tab being such that the openings get superposed during the second translational movement between the start thereof and before the final connection position so as to allow it to get locked, in this open position, still considered open, by any member that gets introduced into the openings.

19 Claims, 3 Drawing Sheets

ELECTRICAL CONNECTION DEVICE LOCKABLE IN THE OPEN POSITION

BACKGROUND OF THE INVENTION

1. Field of the Invention

The instant invention is related to an electrical connection device that can be locked in the open position, and includes a plug and a female power transmitting element in the form of a socket or a coupler socket of an extension cord.

2. Background Information

Electrical connection devices are known which comprise a cylindrical body equipped with internal contact pins and a female power transmitting element, with the female power transmitting element being in the form of a socket or a coupler socket of an extension cord and provided with a casing equipped with internal contacts and an external rotational ring that projects by extending beyond the casing and is intended to lock and unlock the plug into and from a closed, connection position of the electrical connection devices.

In this type of device, the coupling is generally done via paired guide elements that are part of the plug and the female elements, by at least one first translational movement of the plug in the female element, followed by a rotation, and then a second translation until the closed, connection position is achieved.

Guide systems for these coupling maneuvers are known, and they generally comprise pins arranged on the plug and guide ramps arranged on the inner wall of the female element.

The fact that there is a rotational movement before the last translational movement especially allows one to retain the plug momentarily in the female element after disconnection, even if the movement is aided by special elastic mechanisms or simply by the elastic nature of the contacts when it is a matter of pressure contacts.

Especially for reasons of safety, it would be to be advantageous to be able to lock such a device in the open position, so as to, for example, prevent any accidental or ill-intentioned coupling.

SUMMARY OF THE INVENTION

According to the present invention, electrical connection devices of the type discussed above are provided than can be locked in an open, electrically unconnected position. The device of the present invention is especially notable in that the plug body is equipped at its base with a locking tab that extends axially in the direction of coupling and at a distance from the body so as to be able to pass above a locking ring during coupling, and in that the tab and the locking ring each have an opening, with the angular positions of the openings and the longitudinal position of the opening of the tab being such that the openings are superposed during the second translational movement between the start of such movement and before the final connection position so as to enable a locking, in this open position, which is still considered open, by any mechanism that is introduced into the openings.

Advantageously, the cut-out of the locking ring is arranged in that portion of the ring that projects from the casing of the female element in such a way that in the open, locking position, the locking mechanism, such as a padlock, can pass through the cut-out of the ring and return into the space comprised between the ring and the plug body.

Preferably, the open locking position, wherein the cut-outs of the plug and of the ring are capable of being superposed, is obtained after the start of the second translational coupling movement such that in the open locking position, the plug is already blocked rotationally by the paired guide elements of the plug and of the female element.

Further to the above, in one aspect the present invention is directed to an electrical connection device lockable in an open position, comprising a plug comprising a cylindrical body including internal contact pins; a power transmitting female element comprising a casing including internal contacts and an external rotational locking ring projecting beyond the casing to enable locking and unlocking of the plug from or into a closed, connection position; paired guide elements associated with the plug and the female element to enable coupling of the plug to the female element by at least one first translational movement of the plug in the female element, followed by a rotation, and then a second translation to the closed connection position; a locking tab positioned on a base of the plug, the locking tab extending axially in a direction of coupling and at a distance from the body so as to be able to pass above the rotation ring during the coupling; and an opening associated with each of the locking tab and the locking ring, each the opening having an angular and longitudinal position so that the opening associated with the locking tab and the cut-out associated with the locking ring are superposed during the second translational movement between and including a start of the second translational movement up to the closed, connection position to enable locking in an open position by insertion of a locking member into the superposed openings.

In another aspect, the present invention is directed to an electrical connection device lockable in an open position, comprising a plug comprising a body including contact pins; a power transmitting female element comprising a casing including contacts and a rotational locking ring projecting beyond the casing to enable locking and unlocking of the plug from or into a closed, connection position; guide elements associated with the plug and the female element to enable coupling of the plug to the female element by at least one first translational movement of the plug in the female element, followed by rotation, and then a second translation to the closed connection position; a locking tab positioned on a base of the plug, the locking tab extending axially in a direction of coupling and at a distance from the body; an opening associated with each of the locking tab and the locking ring, each the opening having an angular and longitudinal position so that the opening associated with the locking tab and the opening associated with the locking ring are superposed during the second translational movement between and including a start of the second translational movement up to the closed, connection position to enable locking in an open position by insertion of a locking member into the superposed openings.

The female element can comprise a socket or a coupler socket of an extension cord.

The opening of the locking ring can be positioned in a portion of the lockable ring that projects from the female element, a space can be formed between the body of the plug and the locking ring; and, in the open position, the locking member can pass through the opening of the lockable ring and within the space. Also, the open, locking position, in which the openings are superposed, can be obtained after initiation of the second translational coupling movement such that in he open, locking position, the plug is already rotationally blocked by the paired guide elements.

The female element can include contacts which ensure independent opening and closure functions of a circuit breaker.

The electrical connection device can include indicia for determining the open position and/or the closed position. The first and second indicia can comprise first and second colors, with the first and second colors being different colors. Also, a window can be provided through which the first and second colors are viewable.

The invention is especially intended to be used in devices that are designed for or used as integrated circuit breakers-insulating switches, as, for example, in commonly assigned FR 2 531 577, and its family member, U.S. Pat. No. 4,516,819, the disclosures of which are incorporated by reference in their entireties, and most especially in devices where the female power transmitting element is equipped with contacts that ensure the functions of a circuit breaker that can be opened or shut independently, or in other words independently of the speed at which the coupling or separation is done.

BRIEF DESCRIPTION OF DRAWINGS

The invention will be better understood and other characteristics thereof will become more apparent from the description that follows, with reference to the annexed drawings wherein.

DETAILED DESCRIPTION OF THE INVENTION

Figure 2:
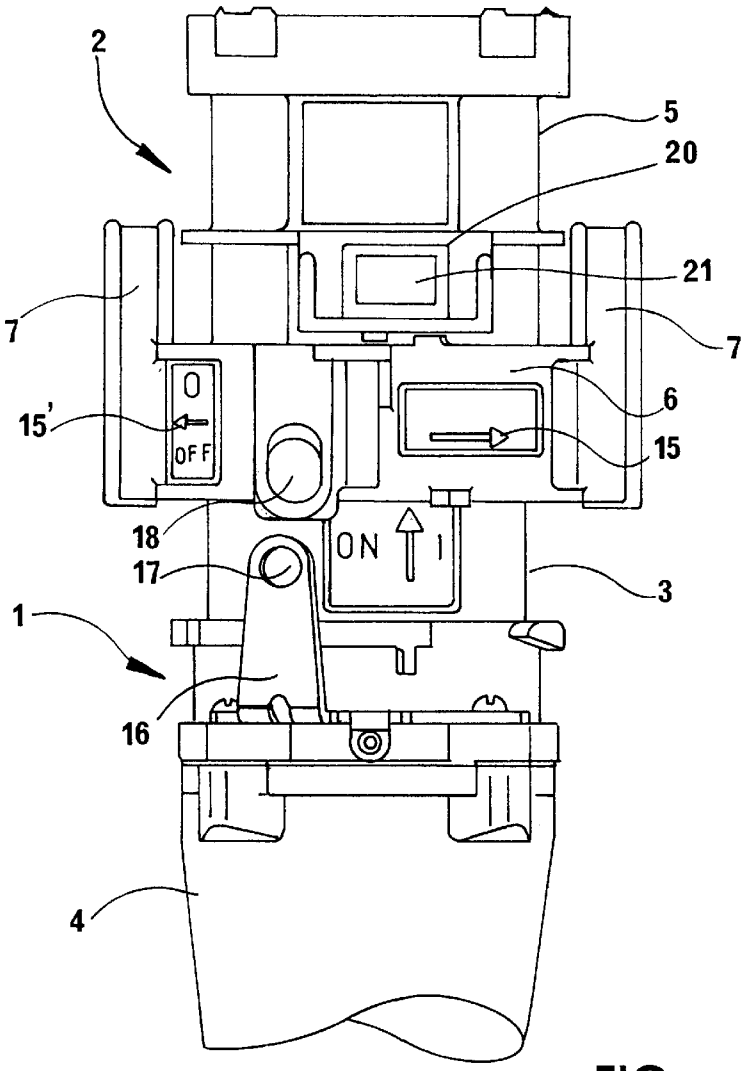
FIGS. 2 and 3 illustrate the device in the intermediate coupling positions.

As illustrated in the figures of drawings, the electrical connection device according to the invention comprises a plug 1 intended to get connected into a female power transmitting element, such as the illustrated socket 2, with the plug and socket assembly thus forming a connection. While a socket is illustrated in the drawings, other female members can be utilized with the plug 1 to obtain a connection, such as a mobile outlet, with the plug and coupler socket thus forming an extension cord. In particular, in order to form the coupler socket of an extension cord instead of the illustrated socket 2, the socket need only be equipped with a fixed connector forming a handle.

The plug 1 comprises a cylindrical body 3 in which contacts are provided, generally in the form of contact pins, the body being affixed to a fixed connector forming the handle 4.

The socket 2 comprises a casing 5 equipped with a ring 6 for locking the elements into the connection position, or in other words, in the position considered to be the closed or closure position, the ring being rotationally mounted and projecting from the casing 5 by extending axially towards the outside.

The ring 6 here comprises rotational actuation vanes 7.

Figure 5:
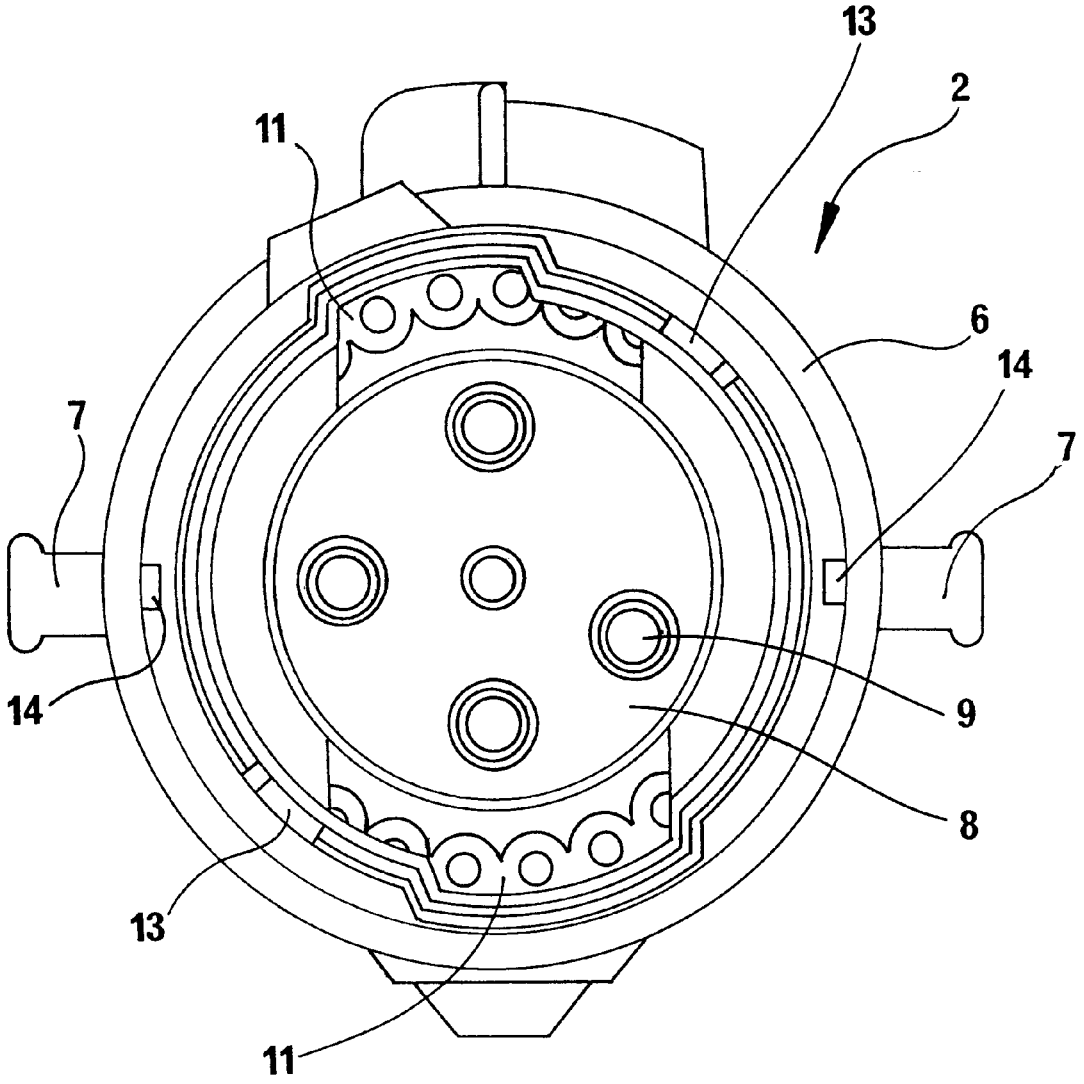
FIG. 5 is an end view of the female element.

In the casing 5, such as shown in FIG. 5, is arranged an insulating unit 8 in which are provided contacts, for example, relay contacts, i.e., having the power for opening and closure incorporated into them.

The contacts of the insulating unit 8 are accessible via the contact pins of the plug, which get introduced into the housings arranged in the unit 8, as, for example, the housings 9 represented in FIG. 5.

During the above-cited movement, the tubular cylindrical body of the plug gets introduced into the space comprised between the outer wall of unit 8 and the inner wall of casing 5, such space being clearly visible in FIG. 5.

The ring 6 is provided especially to ensure the locking and unlocking of the plug into and from the connection position in the socket 2, as will be explained later.

Figure 1:
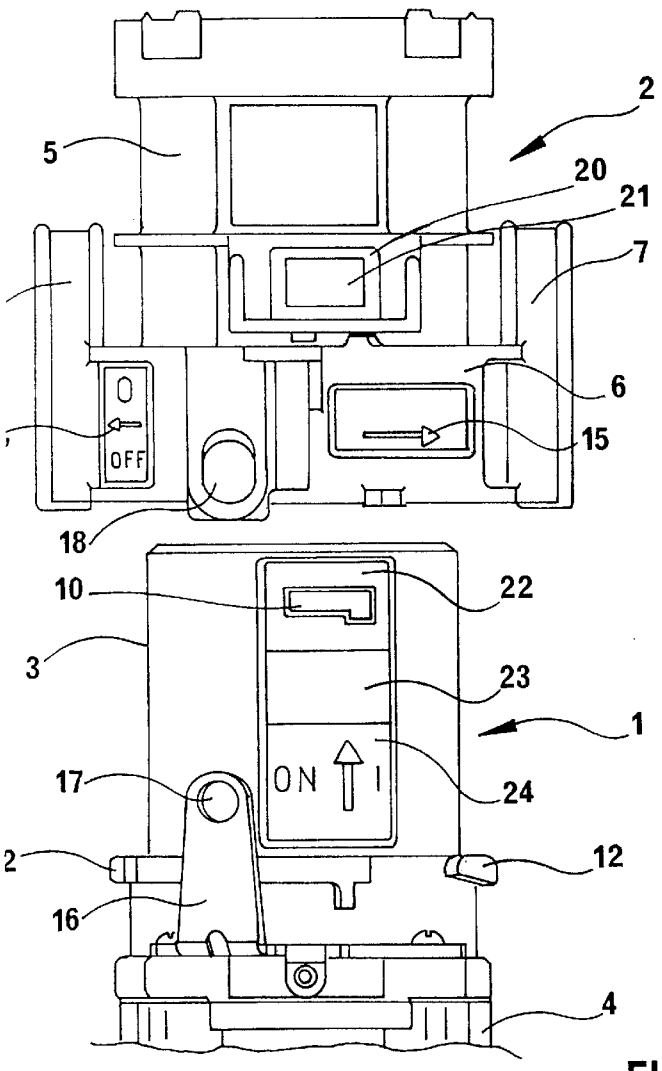
FIG. 1 shows a connection device according to the invention, wherein the plug and the female element are completely separate.

The body 3 of plug 1 and the casing 5 of socket 2 comprise paired members, such as pins 10 on the plug (FIG. 1) and guide ramps 11 in the casing (FIG. 5), in order to guide the coupling movements.

Figure 4:
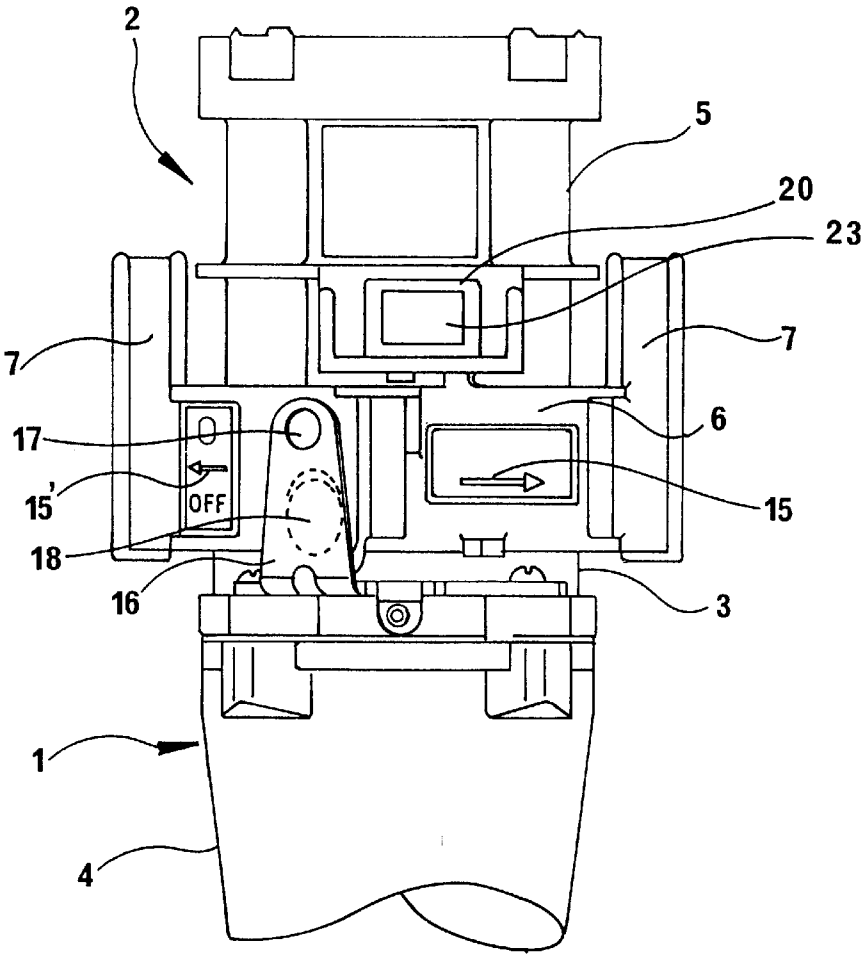
FIG. 4 illustrates a complete connection position, or in other words, the closure position.
Figure 3:
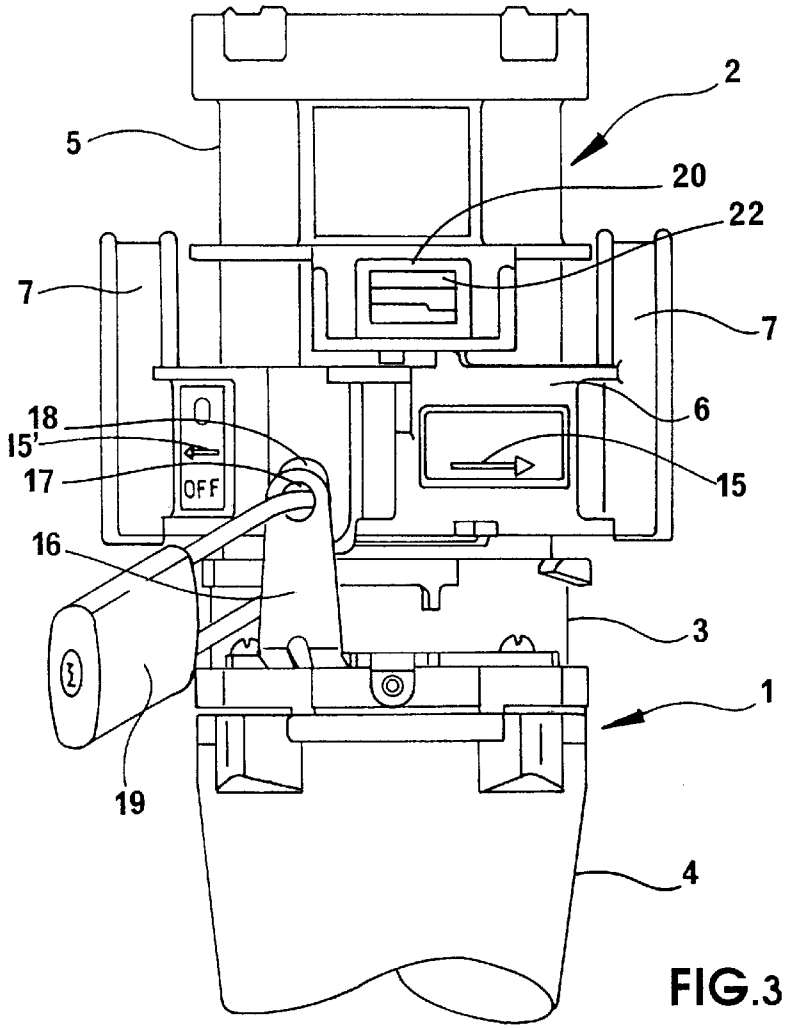

The guide ramps 11 traditionally have a zig-zag shape such that the coupling occurs as per a first translational movement, followed by a rotational movement in order to reach the position illustrated in FIG. 2, and finally a last translational movement until the closure position is obtained, i.e., the connection position (FIGS. 3 and 4).

In this last position (FIG. 4), the ring 6 ensures the locking of the plug, for example, by means of catching abutments 12, for the plug (FIG. 1) and 13 for the ring (FIG. 5), the passage of the latter elements beneath the abutments 12 taking place here by the automatic rotation of the ring by means of, for example, small retractable pins 14 (FIG. 5) for the unlocking of the ring.

In addition here, in the last connection position illustrated in FIG. 4, the ring can be turned in the direction of the arrow 15 to undertake a tightening, thus ensuring, by virtue of a joint, a good seal of the assembly.

Unlocking is obtained by the inverse rotation of ring 6 in the direction of arrow 15'.

It is understood that the connection is obtained by the last translational movement (FIGS. 2 to 4) during which the contact pins of the plug get introduced into the insulating unit 8 until the connection is ensured.

As can be seen in the drawings, plug 1 comprises a tab 16 fixed at the base of the body 3 and which extends in the direction of the connection at a distance from the body.

The tab 16 is equipped at its frontal end with an opening or cut-out 17.

Similarly, ring 6 is provided with an opening or cut-out 18 towards the edge of its frontal end.

The angular position of the openings 17 and 18 respectively of the plug and of the ring is such that the openings are aligned at the end of the coupling rotation (FIG. 2) and thus during the entire last translational movement (FIGS. 2 to 4).

The longitudinal position of the opening 17 is selected, in addition, in such a way that the openings 17 and 18 get superposed during the last translational movement in such a position that the connection is not yet established, i.e., in the opening position, considered to still be opened or open, as can be seen from FIG. 3.

In addition, we also understand that the tab 16 is at a sufficient distance from the body 3 so as to pass above the ring 6.

Thus, in the position of FIG. 3, the device can be locked by any means passing through the cut-outs 17 and 18, such as a padlock 19, represented in the drawing.

The loop of the padlock 19 can thus return beneath the cut-out 18 due to the space comprised between the body 3 of the plug and the ring 6.

Moreover, it should also be noted that in the position of FIG. 3, the plug is already rotationally blocked by the previously described elements, and this reinforces the locking further, although it would be possible to provide this locking position right at the beginning of the last translational movement, i.e., before the rotational locking.

Finally, it should also be noted that the casing 5 of socket 2 is provided, in this embodiment, with a window 20 that allows one to see, at a given moment and depending on the relative positions of the plug and the socket, the body of the plug which gets interposed between the insulating unit 8 of the socket and the window, i.e., either a zone 21 colored in a first color, provided on the outer wall of the insulating unit 8 (FIGS. 1 and 2), or a colored zone 22 or 23 provided on the body of the plug (FIG. 1), which in this case also comprises a third zone 24.

The frontmost zone 22 of the plug is of the same color as the zone 21 of the unit, and the zone 23 is of another color, such that in the open position (FIGS. 1 to 3), one can see the colored zone 21 of the unit (FIGS. 1 and 2) or the zone 22 of the plug (FIG. 3) in the window, the zones 21 and 22 being, as has already been noted, of the same color, whereas in the closure position (FIG. 4), it is the colored zone 23 of the plug that can be seen, which is a zone of another color and indicative of the fact that this is the closed position.

The instant application is based upon the French Patent Application No. 9614760, filed Dec. 2, 1996, whose priority is claimed under 35 U.S.C. 119, and the disclosure of which is hereby expressly incorporated by reference in its entirety.

Although the invention has been described with reference to particular means, materials and embodiments, it is to be understood that the invention is not limited to the particulars disclosed and extends to all equivalents within the scope of the claims.

I claim:

1. Electrical connection device lockable in an open position, comprising:

a plug comprising a cylindrical body including internal contact pins;

a power transmitting female element comprising a casing including internal contacts and an external rotational locking ring projecting beyond said casing to enable locking and unlocking of said plug from or into a closed, connection position;

paired guide elements associated with said plug and said female element to enable coupling of said plug to said female element by at least one first translational movement of said plug in said female element, followed by a rotation, and then a second translational movement to the closed connection position;

a locking tab positioned on a base of said plug, said locking tab extending axially in a direction of coupling and at a distance from said body so as to be able to pass above said rotation ring during the coupling; and an opening associated with each of said locking tab and said locking ring, each said opening having an angular and longitudinal position so that the opening associated with said locking tab and the cut-out associated with the locking ring are superposed during the second translational movement between and including a start of the second translational movement up to the closed, connection position to enable locking in an open position by insertion of a locking member into the superposed openings.

2. The electrical connection device according to claim 1, wherein said female element comprises a socket.

3. The electrical connection device according to claim 1, wherein said female element comprises a coupler socket of an extension cord.

4. The electrical connection device according to claim 1, wherein said opening of said locking ring is positioned in a portion of said lockable ring that projects from said female element; a space is formed between said body of said plug and locking ring; and, in the open position, the locking member passes through said opening of said lockable ring and within said space.

5. The electrical connection device according to claim 4, wherein said locking member comprises a padlock.

6. The electrical connection device according to claim 1, wherein the open, locking position, in which said openings are superposed, is obtained after initiation of the second translational coupling movement such that in said open, locking position, said plug is already rotationally blocked by said paired guide elements.

7. The electrical connection device according to claim 4, wherein the open, locking position, in which said openings are superposed, is obtained after initiation of the second translational coupling movement such that in said open, locking position, said plug is already rotationally blocked by said paired guide elements.

8. The electrical connection device according to claim 1, wherein said female element includes contacts which ensure independent opening and closure functions of a circuit breaker.

9. The electrical connection device according to claim 1, including indicia for determining the open position.

10. The electrical connection device according to claim 1, including indicia for determining the closed position.

11. The electrical connection device according to claim 1, including first and second indicia for determining the open and closed position.

12. The electrical connection device according to claim 11, wherein said first and second indicia comprise first and second colors, said first and second colors being different colors.

13. The electrical connection device according to claim 12, including a window through which said first and second colors are viewable.

14. Electrical connection device lockable in an open position, comprising:

a plug comprising a body including contact pins;

a power transmitting female element comprising a casing including contacts and a rotational locking ring projecting beyond said casing to enable locking and unlocking of said plug from or into a closed, connection position;

guide elements associated with said plug and said female element to enable coupling of said plug to said female element by at least one first translational movement of said plug in said female element, followed by rotation, and then a second translational movement to the closed connection position;

a locking tab positioned on a base of said plug, said locking tab extending axially in a direction of coupling and at a distance from said body;

an opening associated with each of said locking tab and said locking ring, each said opening having an angular and longitudinal position so that the opening associated with said locking tab and the opening associated with the locking ring are superposed during the second translational movement between and including a start of the second translational movement up to the closed, connection position to enable locking in an open position by insertion of a locking member into the superposed openings.

15. The electrical connection device according to claim 14, wherein said female element comprises a socket.

16. The electrical connection device according to claim 14, wherein said female element comprises a coupler socket of an extension cord.

17. The electrical connection device according to claim 14, wherein said opening of said locking ring is positioned in a portion of said lockable ring that projects from said female element; a space is formed between said body of said plug and locking ring; and, in the open position, the locking member passes through said opening of said lockable ring and within said space.

18. The electrical connection device according to claim 17, wherein said locking member comprises a padlock.

19. The electrical connection device according to claim 14, wherein the open, locking position, in which said openings are superposed, is obtained after initiation of the second translational coupling movement such that in said open, locking position, said plug is already rotationally blocked by said paired guide elements.

* * * * *